US009850781B2

(12) United States Patent
Shibukawa et al.

(10) Patent No.: US 9,850,781 B2
(45) Date of Patent: Dec. 26, 2017

(54) STEAM TURBINE

(71) Applicant: KABUSHIKI KAISHA TOSHIBA, Minato-ku (JP)

(72) Inventors: Naoki Shibukawa, Saitama (JP); Tomohiko Tsukuda, Yokohama (JP); Junichi Tominaga, Yokohama (JP); Shinichiro Ohashi, Ota-ku (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 835 days.

(21) Appl. No.: 14/315,837

(22) Filed: Jun. 26, 2014

(65) Prior Publication Data

US 2015/0003969 A1 Jan. 1, 2015

(30) Foreign Application Priority Data

Jun. 27, 2013 (JP) ..... 2013-134449

(51) Int. Cl.

| | |
|---|---|
| ***F01D 25/32*** | (2006.01) |
| *F01D 9/04* | (2006.01) |
| *F01D 1/00* | (2006.01) |

(52) U.S. Cl.

CPC ..... *F01D 25/32* (2013.01); *F01D 9/041* (2013.01); *F01D 1/00* (2013.01); *F01D 9/04* (2013.01);

(Continued)

(58) Field of Classification Search

CPC . F01D 25/32; F01D 9/04; F01D 9/041; F01D 9/047; F01D 1/00; F05D 2220/31;

(Continued)

(56) References Cited

U.S. PATENT DOCUMENTS 4,948,335 A * 8/1990 Silvestri, Jr. ..... F01K 7/223 415/168.1
5,494,405 A * 2/1996 Gray ..... F01D 25/32 415/211.2

(Continued)

FOREIGN PATENT DOCUMENTS

DE 1 576 982 7/1967
EP 0 375 983 A1 7/1990

(Continued)

OTHER PUBLICATIONS

JPS63176602 (A)—Translation from Espacenet.*

(Continued)

*Primary Examiner* — Woody Lee, Jr.
*Assistant Examiner* — Behnoush Haghighian
(74) *Attorney, Agent, or Firm* — Oblon, McClelland, Maier & Neustadt, L.L.P.

(57) ABSTRACT

A steam turbine 10 according to an embodiment includes rotor blades 22 implanted to a turbine rotor 21, stationary blades 26 making up a turbine stage together with the rotor blades 22, diaphragm outer rings 23 including an annular extending part 24 surrounding a periphery of the rotor blades 22, and supporting the stationary blades 26, and diaphragm inner rings 25 supporting the stationary blades 26. The steam turbine 10 further includes an annular slit 40 formed at an inner surface of the diaphragm outer ring 23 between the stationary blades 26 and the rotor blades 22 along a circumferential direction, and communication holes 50 provided in plural at an outer surface of the diaphragm outer ring 23 along the circumferential direction, communicated to the annular slit 40 from the outer surface side, and communicated to an exhaust chamber sucking water films via the annular slit 40.

13 Claims, 11 Drawing Sheets

(52) U.S. Cl.
CPC ..... *F01D 9/047* (2013.01); *F05D 2220/31* (2013.01); *F05D 2260/602* (2013.01); *F05D 2260/608* (2013.01)

(58) Field of Classification Search
CPC ..... F05D 2260/602; F05D 2260/608; F05D 2260/95
See application file for complete search history.

(56) References Cited

U.S. PATENT DOCUMENTS

| | | | | |
|---|---|---|---|---|
| 6,375,417 | B1 * | 4/2002 | Hofer | F01D 25/32 415/169.4 |
| 7,789,618 | B2 * | 9/2010 | Burdgick | F01D 25/32 415/169.4 |
| 8,132,414 | B2 * | 3/2012 | Niizeki | F01D 5/284 416/241 A |
| 9,598,964 | B2 * | 3/2017 | Ishibashi | F01D 5/145 |
| 2007/0292265 | A1 * | 12/2007 | Burdgick | F01D 5/147 415/169.3 |
| 2009/0123276 | A1 | 5/2009 | Greim et al. | |
| 2010/0221095 | A1 * | 9/2010 | Kostyuchenko | F01D 5/143 415/1 |
| 2010/0232966 | A1 | 9/2010 | Ono et al. | |
| 2012/0210715 | A1 * | 8/2012 | Shibata | F01D 5/141 60/670 |
| 2013/0189077 | A1 * | 7/2013 | Tsukuda | F01D 5/14 415/92 |

FOREIGN PATENT DOCUMENTS

| | | | | |
|---|---|---|---|---|
| JP | 49-9522 | | | 3/1974 |
| JP | 55-60404 | U1 | | 10/1978 |
| JP | 56-41101 | U1 | | 9/1979 |
| JP | 54-153908 | A | | 12/1979 |
| JP | 61-265305 | A | | 11/1986 |
| JP | 63-176602 | A | | 7/1988 |
| JP | S 63176602 | A | * | 7/1988 |
| JP | 8-158810 | A | | 6/1996 |
| JP | 2000-145404 | A | | 5/2000 |
| JP | 2009-121468 | A | | 6/2009 |
| JP | 2010-13782 | | | 1/2010 |
| JP | 2010-203438 | A | | 9/2010 |
| JP | 2010-216321 | A | | 9/2010 |
| JP | 2011-69308 | A | | 4/2011 |
| JP | 2011069308 | A | * | 4/2011 |
| JP | 2012-2135 | | | 1/2012 |
| JP | 2012-172588 | A | | 9/2012 |

OTHER PUBLICATIONS

JP2011069308 (A)—Translation from Espacenet.*
Extended European Search Report dated Oct. 29, 2015 in Patent Application No. 14174843.4.
Office Action dated Nov. 22, 2016 in Japanese Patent Application No. 2013-134449 (with unedited computer generated English translation).
Office Action dated Mar. 7, 2017 in Japanese Patent Application No. 2013-134449 (with unedited computer generated English translation).

* cited by examiner

STEAM TURBINE

CROSS-REFERENCE TO RELATED APPLICATION

This application is based upon and claims the benefit of priority from Japanese Patent Application No. 2013-134449, filed on Jun. 27, 2013; the entire contents of all of which are incorporated herein by reference.

FIELD

Embodiments described herein relate generally to a steam turbine.

BACKGROUND

At a low-pressure part of a nuclear power turbine, a geothermal turbine, or a thermal power turbine, a temperature and a pressure of steam being a working fluid are low. Accordingly, a part of the steam is condensed during expansion work to be water droplets to adhere to an inner wall of a steam passage, a stationary blade, and a rotor blade. The water droplets generated at the steam passage grow into the water droplets whose particle diameters are large. The water droplets whose particle diameters are large collide with a leading edge and so on of the rotor blade, and thereby, the rotor blade is eroded and a collision resistance relative to a rotation of the rotor blade is generated to lower turbine efficiency.

Here, a flow of the steam and so on in a vicinity of a turbine stage at a final stage in a general low-pressure turbine is described. FIG. 12 is a view illustrating a meridian cross section in a vicinity of a final turbine stage in a conventional low-pressure turbine. Note that in FIG. 12, a dotted line represents a streamline of the steam, and a solid line represents a trace of the generated water droplets.

As illustrated in FIG. 12, diaphragm outer rings 310*a*, 310*b*, diaphragm inner rings 311*a*, 311*b* are included at an inner side of a casing 300. Between the diaphragm outer rings 310*a*, 310*b* and the diaphragm inner rings 311*a*, 311*b*, plural stationary blades 312*a*, 312*b* are supported in a circumferential direction to make up a stationary blade cascade.

At an immediate downstream side of the stationary blade cascade, a rotor blade cascade in which plural rotor blades 322*a*, 322*b* are implanted into rotor disks 320*a*, 320*b* of a turbine rotor in the circumferential direction is made up. A single stage turbine stage is made up by the stationary blade cascade and the rotor blade cascade positioning at the immediate downstream thereof. In FIG. 12, a final turbine stage 330 and a turbine stage 331 at upstream side for one stage than the final turbine stage 330 are illustrated. At the rotor blades 322*a*, 322*b*, a speed energy of the steam expanded at the stationary blades 312*a*, 312*b* is converted into a rotational energy to generate a motive power.

As illustrated in FIG. 12, the steam expands along the steam passage which increases in size as it goes downstream. The water droplets are generated at a part where the pressure and the temperature of the steam descend, for example, at the turbine stage 331 which is at upstream for one stage than the final turbine stage 330.

A part of the generated water droplets flows toward the diaphragm outer ring 310*a* of the turbine stage 330 affected by the centrifugal force and the coriolis force. Accordingly, a lot of water droplets adhere to an inner surface of the diaphragm outer ring 310*a* of the turbine stage 330 to form a water film.

Besides, remaining water droplets collide with and adhere to a surface of the stationary blade 312*a* to form the water film. A water film reaching a trailing edge of the stationary blade 312*a* is blown and torn off by a steam flow at the trailing edge to be the water droplets. The water droplets collide with the rotor blade 322*a* at the immediate downstream side to erode the rotor blade 322*a*, activate a force in a reverse direction with a rotational direction to lower turbine efficiency.

Here, FIG. 13 is a view illustrating a distribution of wetness of the steam in a blade height direction of the stationary blade at the final turbine stage of the conventional low-pressure turbine. Note that a vertical axis represents a blade height ratio in which each blade height position is divided by a blade height. For example, when the blade height ratio is "1", it indicates a blade tip of the stationary blade, and when the blade height ratio is "0" (zero), it indicates a blade root of the stationary blade. As illustrated in FIG. 13, the wetness becomes high at the tip side of the stationary blade, namely, at the diaphragm outer ring side. Accordingly, an adverse effect caused by the generated water droplets becomes remarkable at the diaphragm outer ring side.

In the conventional steam turbine, a technology to remove the generated water droplets and water film has been studied to suppress the erosion by the water droplets and the lowering of the turbine efficiency. As the technology to remove the water droplets and the water film, there is a technology providing plural through holes in the circumferential direction of the diaphragm outer ring to remove the water film adhered to an inner surface of the diaphragm outer ring.

However, when the plural through holes are provided in the circumferential direction of the diaphragm outer ring, the through holes are formed at a limited area between the stationary blade and the rotor blade, and therefore, it is impossible to enough expand a bore diameter. Accordingly, it is necessary to form a lot of through holes in the circumferential direction to uniformly remove the water film and the water droplets in the circumferential direction. This incurs complication of a manufacturing process, and increase in manufacturing cost.

DETAILED DESCRIPTION

In one embodiment, provided is a steam turbine where wet steam flows in a turbine stage in low-pressure. This steam turbine includes: rotor blades implanted in a circumferential direction to a turbine rotor provided to penetrate in a casing; stationary blades provided at an immediate upstream side of the rotor blades in the circumferential direction, and making up a turbine stage together with the rotor blades; diaphragm outer rings provided inside the casing, each including an annular extending part surrounding a periphery of the rotor blades, and supporting the stationary blades from outside in a radial direction; and diaphragm inner rings supporting the stationary blades from inside in the radial direction. The steam turbine further includes: an annular slit formed at an inner surface of the diaphragm outer ring between the stationary blades and the rotor blades along the circumferential direction; and communication holes provided in plural at an outer surface of the diaphragm outer ring along the circumferential direction, communicated to the annular slit from the outer surface side of the diaphragm outer ring, and communicated to a suction part sucking liquid via the annular slit.

Hereinafter, embodiments of the present invention are described with reference to the drawings.

First Embodiment

Figure 1:
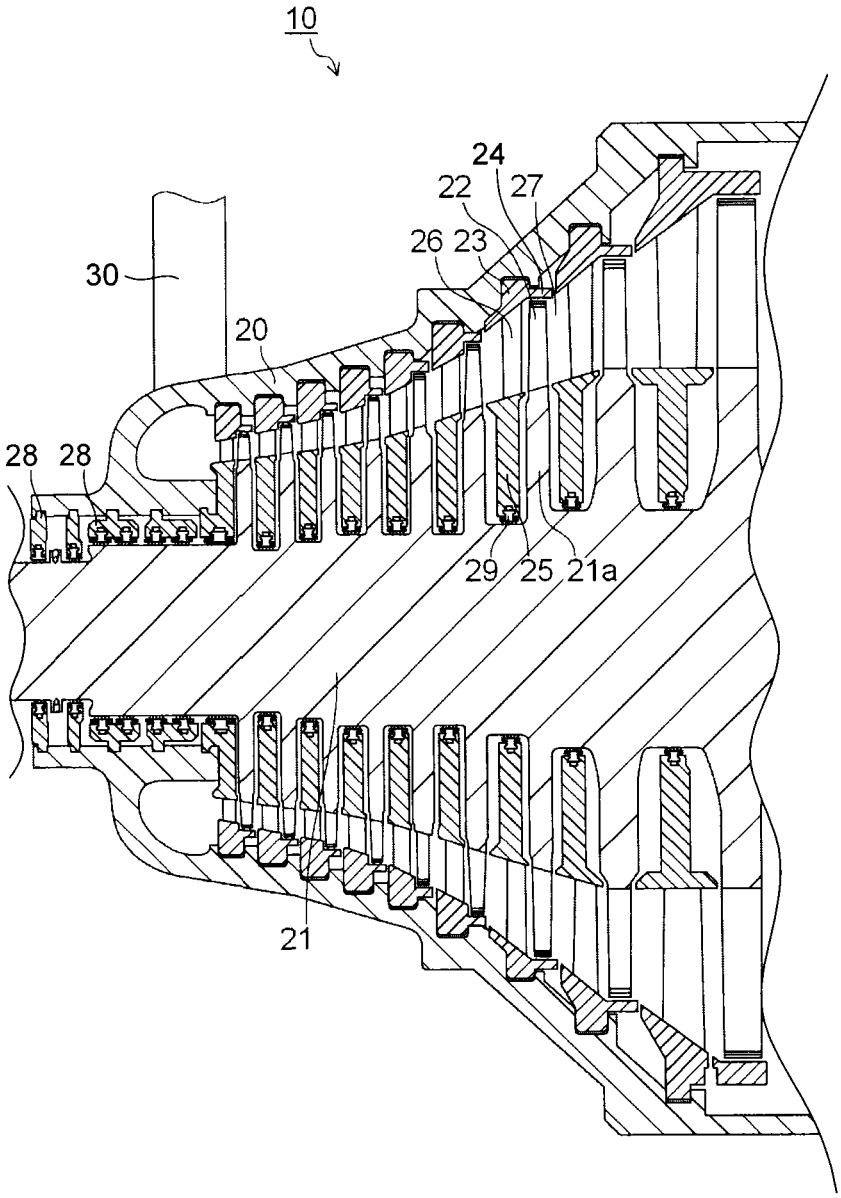
FIG. 1 is a view illustrating a cross section in a vertical direction of a steam turbine according to a first embodiment.

FIG. 1 is a view illustrating a cross section in a vertical direction of a steam turbine 10 according to a first embodiment. Note that the steam turbine described hereinbelow is a low-pressure turbine.

As illustrated in FIG. 1, the steam turbine 10 includes a casing 20. A turbine rotor 21 is provided to penetrate in the casing 20. Rotor disks 21*a* are formed at the turbine rotor 21. Plural rotor blades 22 are implanted to the rotor disk 21*a* in a circumferential direction. Rotor blade cascades including the plural rotor blades 22 in the circumferential direction are made up in plural stages in an axial direction of the turbine rotor 21. Note that the turbine rotor 21 is rotatably supported by a not-illustrated rotor bearing.

Diaphragm outer rings 23 are provided at an inner side of the casing 20. Each diaphragm outer ring 23 extends annularly toward a downstream side, and includes an annular extending part 24 surrounding a periphery of the rotor blade 22. Diaphragm inner rings 25 are provided at an inner side of the diaphragm outer ring 23.

Besides, plural stationary blades 26 are disposed in the circumferential direction between the diaphragm outer ring 23 and the diaphragm inner ring 25 to make up a stationary blade cascade. The diaphragm outer ring 23 supports the stationary blade 26 from outside in a radial direction. The diaphragm inner ring 25 supports the stationary blade 26 from inside in the radial direction. The stationary blade cascades are included in plural stages alternately with the rotor blade cascades in the axial direction of the turbine rotor 21. One turbine stage is made up by the stationary blade cascade and the rotor blade cascade positioning at an immediate downstream side.

An annular steam passage 27 where main steam flows is formed between the diaphragm outer ring 23 and the diaphragm inner ring 25. A flow passage cross section of the steam passage 27 gradually expands as it goes, for example, downstream. A gland sealing part 28 is provided between the turbine rotor 21 and the casing 20 to prevent leakage of the steam toward outside. Besides, a sealing part 29 is provided between the turbine rotor 21 and the diaphragm inner ring 25 to prevent that the steam leaks therebetween toward downstream side.

Besides, a steam inlet pipe (not-illustrated) to introduce the steam from a crossover pipe 30 into the steam turbine 10 is provided at the steam turbine 10. This steam inlet pipe is provided to penetrate the casing 20. An exhaust passage (not-illustrated) to exhaust the steam having performed expansion work at each turbine stage is provided at a downstream side of a final turbine stage. This exhaust passage is communicated to a condenser (not-illustrated).

Next, a constitution of the turbine stage which becomes low-pressure and where wet steam flows is described in detail.

Here, the final turbine stage is exemplified to be described as the turbine stage where the wet steam flows. Note that the turbine stage where the wet steam flows is not limited to the final turbine stage. Accordingly, when the wet steam flows, the turbine stage includes the similar constitution as the following final turbine stage even if it is the turbine stage at upstream than the final turbine stage.

Figure 2:
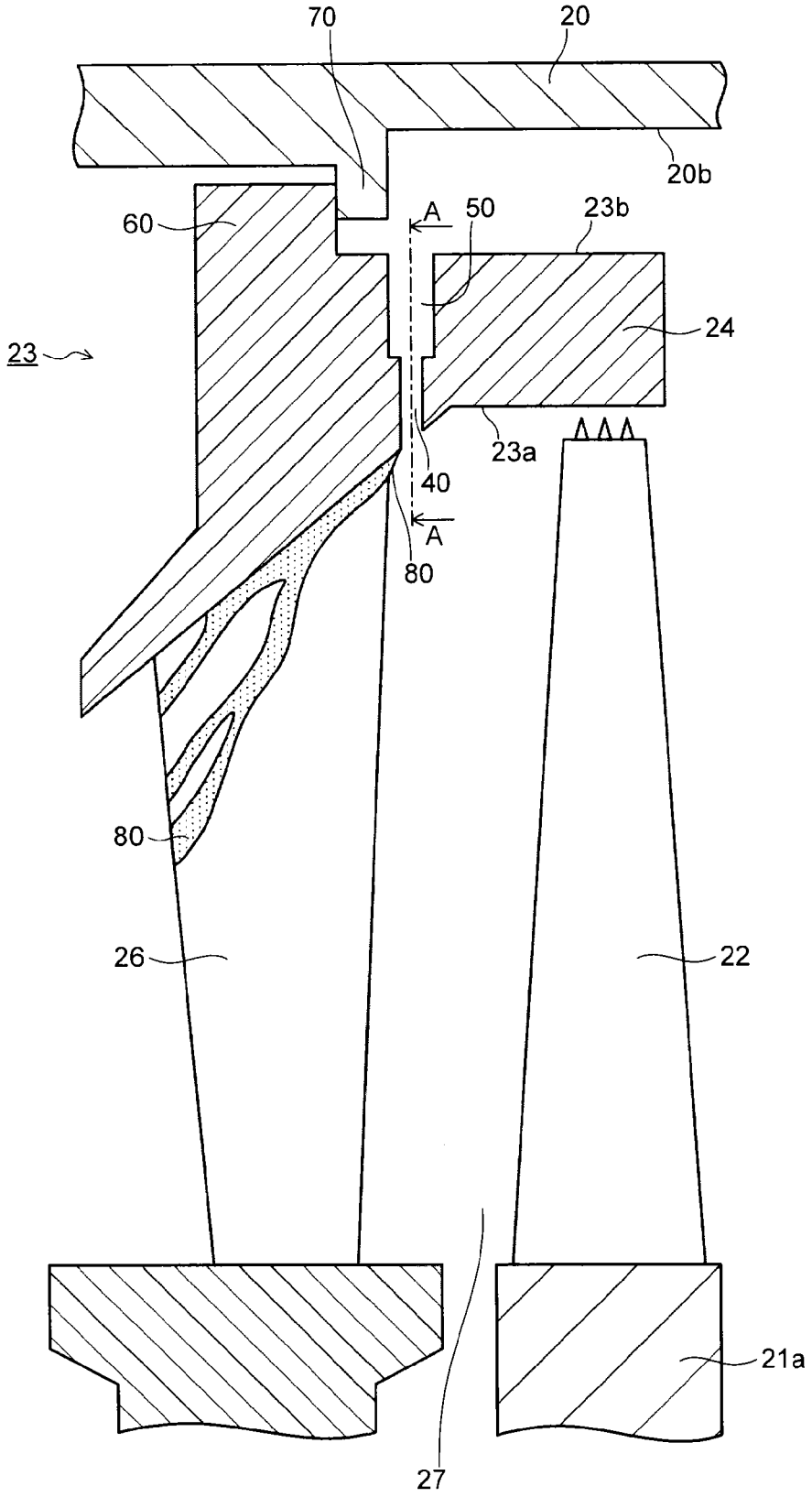
FIG. 2 is a view illustrating a cross section in a vertical direction at an upper half side of a final turbine stage at the steam turbine according to the first embodiment.
Figure 3:
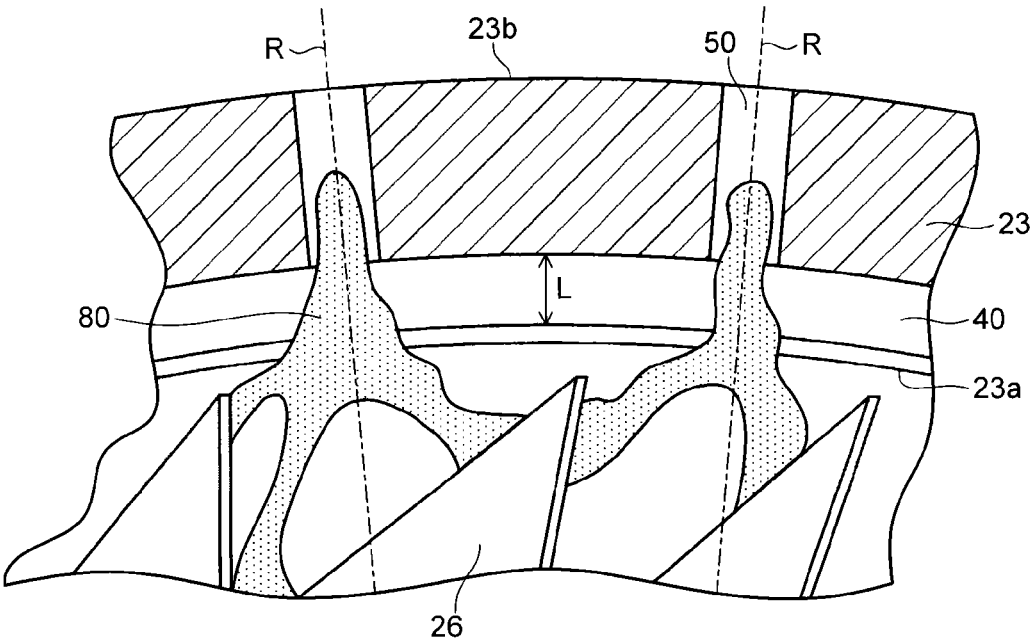
FIG. 3 is a view illustrating an A-A cross section in FIG. 2.
Figure 4:
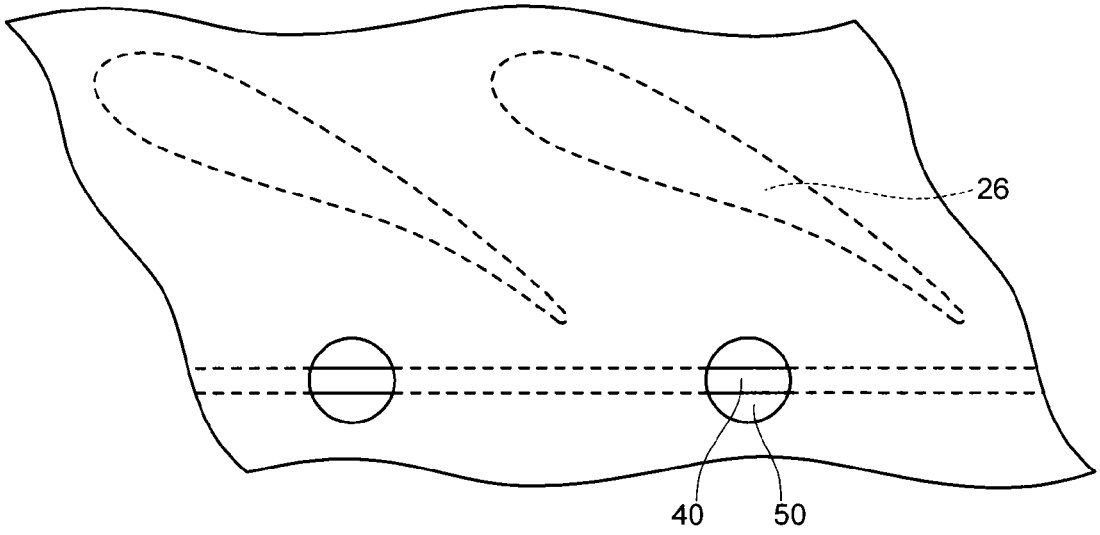
FIG. 4 is a plan view when a diaphragm outer ring of the steam turbine according to the first embodiment is seen from outside in a radial direction.

FIG. 2 is a view illustrating a cross section in a vertical direction at an upper half side of the final turbine stage at the steam turbine 10 according to the first embodiment. FIG. 3 is a view illustrating an A-A cross section in FIG. 2. FIG. 4 is a plan view when the diaphragm outer ring 23 of the steam turbine 10 according to the first embodiment is seen from outside in the radial direction. Note that in FIG. 2 and FIG. 3, water films 80 adhered to the stationary blades 26, an annular slit 40, and a communication hole 50 are also illustrated.

As illustrated in FIG. 1, the annular extending part 24 of the diaphragm outer ring 23 surrounds the periphery of the rotor blade 22 with a minute gap. The annular slit 40 is formed between the stationary blade 26 at an inner surface of the diaphragm outer ring 23 and the rotor blade 22 along the circumferential direction. Namely, the annular slit 40 is made up of an annular groove successive in the circumferential direction.

This annular slit 40 is formed so as not to penetrate the diaphragm outer ring 23 from an inner surface 23*a* of the diaphragm outer ring 23 along outside in the radial direction. A groove depth of the annular slit 40 heading from the inner surface 23*a* of the diaphragm outer ring 23 toward outside in the radial direction is, for example, approximately 20% to 50% of a thickness of the diaphragm outer ring 23.

Plural communication holes 50 are formed at an outer surface 23*b* of the diaphragm outer ring 23 with a predetermined interval (pitch) toward the circumferential direction. The communication holes 50 are formed from the outer surface 23*b* of the diaphragm outer ring 23 to a position communicating to the annular slit 40. The communication holes 50 are, for example, formed along a radial line R extending from a center axis of the turbine rotor 21 in the radial direction at a cross section perpendicular to a turbine rotor axis direction as illustrated in FIG. 3. Namely, the communication holes 50 are, for example, radially formed centering on the center axis of the turbine rotor 21. The communication hole 50 is made up of, for example, a round hole and so on as illustrated in FIG. 4.

Besides, as illustrated in FIG. 2, a protruding ridge part 60 protruding toward outside in the radial direction is formed at an upstream side than the communication hole 50 of the outer surface 23*b* of the diaphragm outer ring 23. This protruding ridge part 60 is in contact with a protruding ridge part 70 protruding toward inside in the radial direction formed at an inner surface 20*b* of the casing 20. The protruding ridge part 60 functions as a sealing part. A space surrounded by the diaphragm outer ring 23 at downstream side than the sealing part and the casing 20 is communicated to, for example, an exhaust chamber (not-illustrated) to exhaust the steam. Namely, the communication hole 50 is communicated to, for example, the exhaust chamber (not-illustrated) to exhaust the steam. Note that the communication hole 50 may be constituted to be, for example, directly communicated to the condenser without being intervened by the exhaust chamber.

Next, operations of the steam turbine 10 are described with reference to FIG. 1 to FIG. 3.

The steam flowing into the steam turbine 10 via the steam inlet tube (not-illustrated) from the crossover tube 30 passes through the steam passage 27 including the stationary blades 26 and the rotor blades 22 of each turbine stage while performing the expansion work, to rotate the turbine rotor 21.

A pressure and a temperature of the steam are lowered as it goes downstream. The pressure and the temperature of the steam are lowered to be wet steam, and water droplets are generated.

A part of the generated water droplets is affected by the centrifugal force and the coriolis force, and flows toward the diaphragm outer ring 23 side. Accordingly, a lot of water droplets adhere to the inner surface of the diaphragm outer ring 23 to form the water film 80. Besides, the remaining water droplets collide with and adhere to a surface of the stationary blade 26 to form the water film 80 as illustrated in FIG. 2. The water film 80 adhered to the stationary blade 26 accumulates at an outer periphery side of the steam passage 27, namely, at the diaphragm outer ring 23 side by the centrifugal force.

Here, a pressure of the annular slit 40 at the steam passage 27 side is approximately the same as an outlet pressure of the stationary blade 26. The outlet pressure of the stationary blade 26 is larger than a pressure at an opening formed at an outer periphery of the diaphragm outer ring 23 of the communication hole 50 communicated to the exhaust chamber (not-illustrated) exhausting the steam.

Accordingly, the water droplets flowing at the diaphragm outer ring 23 side and the water film 80 adhered to the inner surface of the diaphragm outer ring 23 and the stationary blade 26 are sucked from the annular slit 40 toward the communication hole 50 side. The water droplets and the water film sucked from the annular slit 40 are introduced into, for example, the exhaust chamber at a low-pressure side via the communication hole 50. The annular slit 40 is formed along the circumferential direction. Accordingly, the water droplets and the water film dispersed in the circumferential direction are surely collected. Note that the exhaust chamber which is in low-pressure than the opening of the communication hole 50 and sucks the water droplets and the water film functions as a suction part.

The steam passing through the final turbine stage passes through the exhaust chamber (not-illustrated), and is introduced to the condenser (not-illustrated).

As stated above, according to the steam turbine 10 of the first embodiment, the annular slit 40 is provided along the circumferential direction, and thereby, it is possible to surely collect (remove) the water droplets and the water film dispersed in the circumferential direction. It is thereby possible to suppress erosion caused by collision of the water droplets with the rotor blade 22 at the immediate downstream side of the stationary blade 26, and lowering of turbine efficiency.

Here, a constitution of the steam turbine 10 of the first embodiment is not limited to the above-stated constitution.

Figure 5:
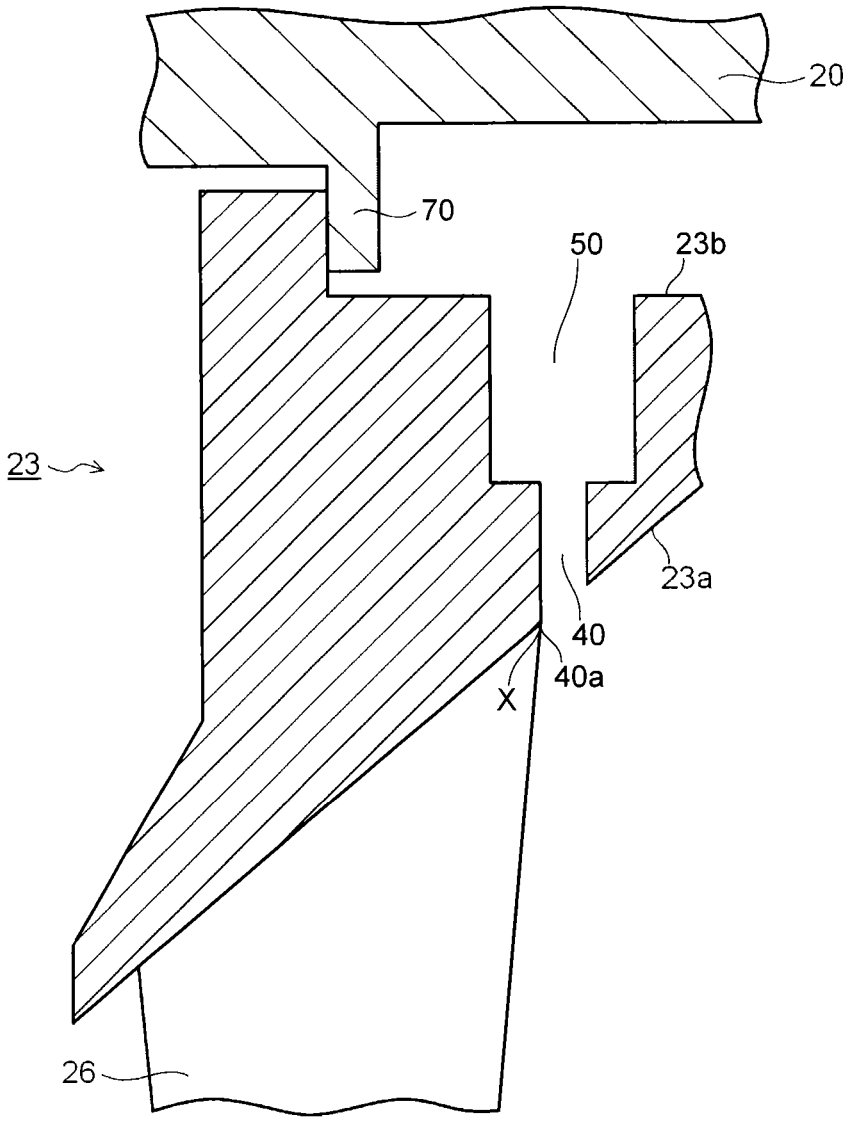
FIG. 5 is a view illustrating a cross section in a vertical direction of a part of the upper half side of the final turbine stage at the steam turbine according to the first embodiment to explain a constitution of another annular slit.
Figure 6:
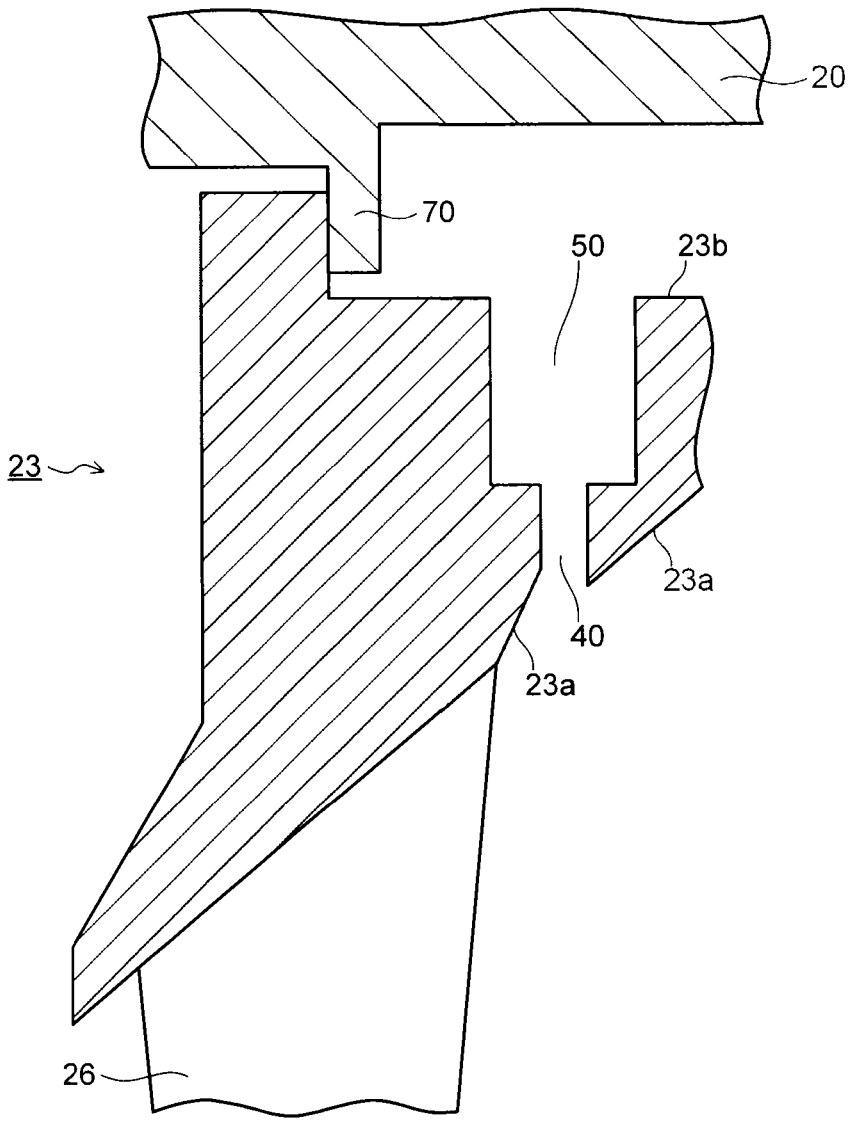
FIG. 6 is a view illustrating a cross section in a vertical direction of a part of the upper half side of the final turbine stage at the steam turbine according to the first embodiment to explain a constitution of still another annular slit.
Figure 7:
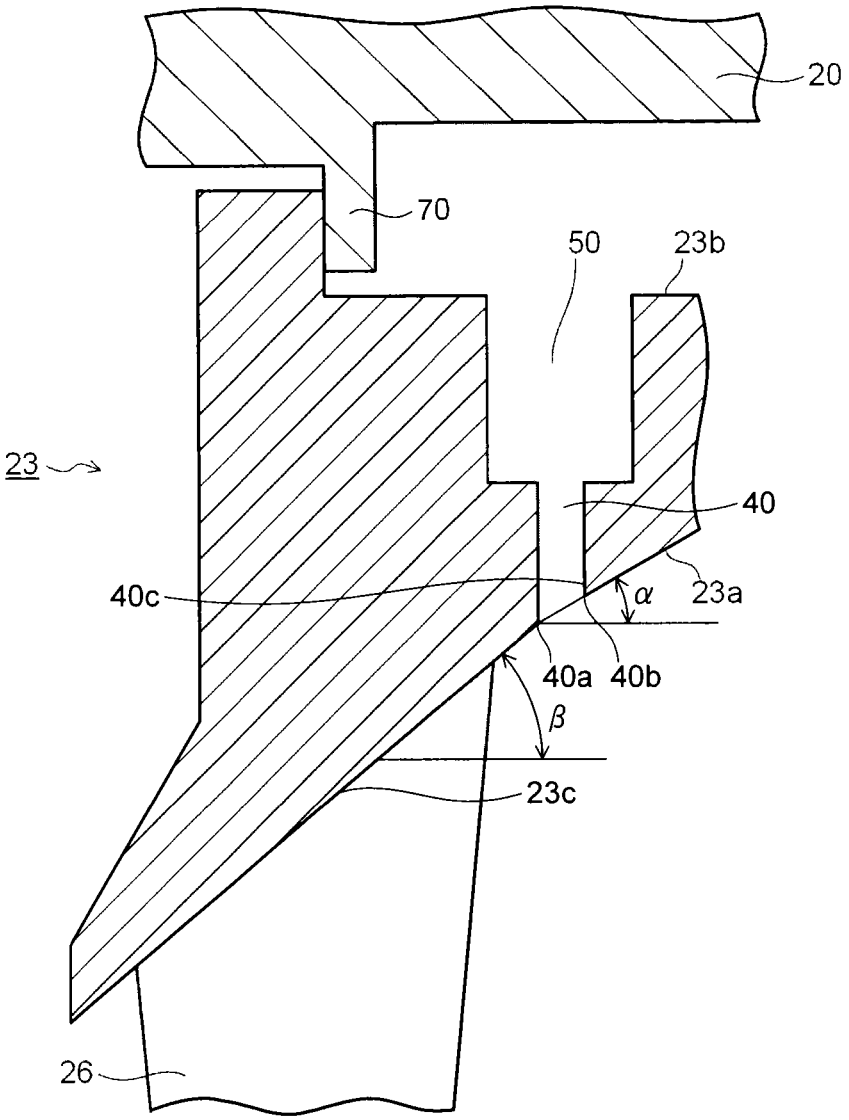
FIG. 7 is a view illustrating a cross section in a vertical direction of a part of the upper half side of the final turbine stage at the steam turbine according to the first embodiment to explain a constitution of yet another annular slit.

FIG. 5 to FIG. 7 are views each illustrating a cross section in a vertical direction of a part of an upper half side of the final turbine stage at the steam turbine 10 according to the first embodiment to explain a constitution of another annular slit 40.

As illustrated in FIG. 5, an end part 40*a* at an upstream side of the annular slit 40 which faces the inner surface 23*a* of the diaphragm outer ring 23 may be constituted such that, for example, the end part 40*a* positions on a circumference including an intersection point X between a trailing edge of a blade tip of the stationary blade 26 and the diaphragm outer ring 23. Namely, at the intersection point X, the end part 40*a* at the upstream side of the annular slit 40, the trailing edge of the blade tip of the stationary blade 26, and the inner surface 23*a* of the diaphragm outer ring 23 intersect.

The annular slit 40 is constituted as stated above, and thereby, it is possible to collect the water film before the water film remaining at the intersection point X scatters.

Besides, as illustrated in FIG. 6, the end part 40*a* at the upstream side of the annular slit 40 which faces the inner surface 23*a* of the diaphragm outer ring 23 may be chamfered. Here, an example in which chamfering (C chamfering) processing the end part 40*a* to a corner surface is performed is illustrated, but chamfering (R chamfering) processing the end part 40*a* to a round surface may be performed.

In this case, as illustrated in FIG. 6, it may be constituted such that an end part at an upstream side of the chamfered surface positions on the circumference including the intersection point X between the trailing edge of the blade tip of the stationary blade 26 and the diaphragm outer ring 23 as same as, for example, the end part 40*a* at the upstream side of the annular slit 40 illustrated in FIG. 5.

As stated above, the chamfering is performed, and thereby, it is possible to collect the water film remaining at the trailing edge of the blade tip of the stationary blade 26 before the water film scatters.

Further, as illustrated in FIG. 7, an acute angle made up of the turbine rotor axis direction and the inner surface 23*a* of the diaphragm outer ring 23 where the annular slit 40 is formed is set to be $\alpha$. An acute angle made up of the turbine rotor axis direction and an inner surface 23*c* of the diaphragm outer ring 23 at the upstream side than the annular slit 40 is set to be β. The inner surface 23*a* may be constituted such that the acute angle α becomes smaller than the acute angle β.

Namely, expansion of the inner surface 23*a* of the diaphragm outer ring 23 where the annular slit 40 is formed toward downstream side is smaller than expansion of the inner surface 23*c* of the diaphragm outer ring 23 at upstream side than the annular slit 40 toward downstream side. Note that the acute angle α is illustrated by, for example, an angle made up of the turbine rotor axis direction and the inner surface 23*a* at the end part 40*a* at the upstream side of the annular slit 40 facing the inner surface 23*a* of the diaphragm outer ring 23 as illustrated in FIG. 7.

It is constituted as stated above, and thereby, the water film and the water droplets reached the annular slit 40 along the inner surface 23*c* of the diaphragm outer ring 23 having the acute angle β collide with an end part 40*b* and an end surface 40*c* at the downstream side of the annular slit 40. Accordingly, it is possible to surely introduce and suck the water film and the water droplets into the annular slit 40.

Here, the inner surface 23*a* of the diaphragm outer ring 23 where the annular slit 40 is formed may be constituted such that the acute angle α becomes "0" (zero). In this case, the inner surface 23*a* is in parallel to the turbine rotor axis direction, and therefore, a process when the annular slit 40 is formed becomes easy.

Figure 8:
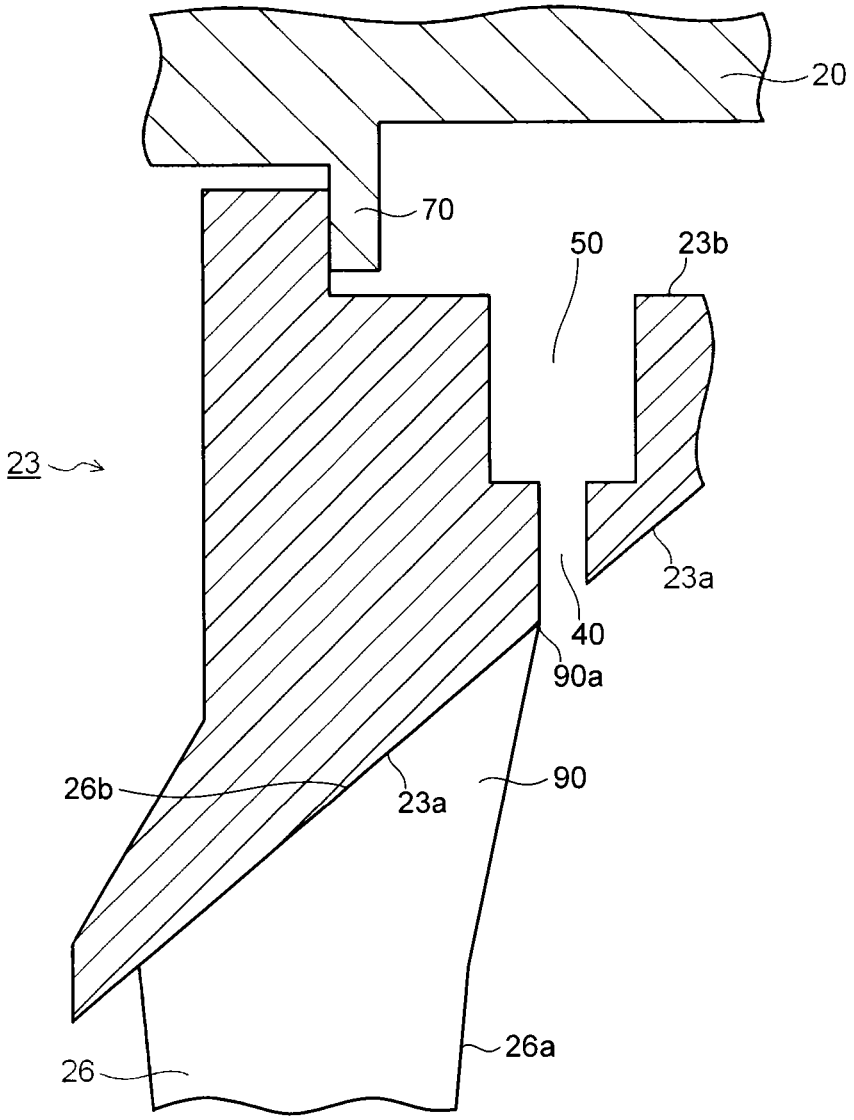
FIG. 8 is a view illustrating a cross section in a vertical direction of a part of the upper half side of the final turbine stage at the steam turbine according to the first embodiment to explain a constitution of another stationary blade.

FIG. 8 is a view illustrating a cross section in a vertical direction of a part of an upper half side of the final turbine stage at the steam turbine 10 according to the first embodiment to explain a constitution of another stationary blade 26.

As illustrated in FIG. 8, at a trailing edge 26*a* positioning at 90% or more of a blade height from a blade root of the stationary blade 26, the trailing edge may be gradually extended as it goes to a blade tip 26*b*. Note that an end part 90*a* at a downstream side of an extending part 90 made up by extending the trailing edge may be constituted so as to intersect with the end part 40*a* at the upstream side of the annular slit 40 facing the inner surface 23*a* of the diaphragm outer ring 23.

Figure 13:
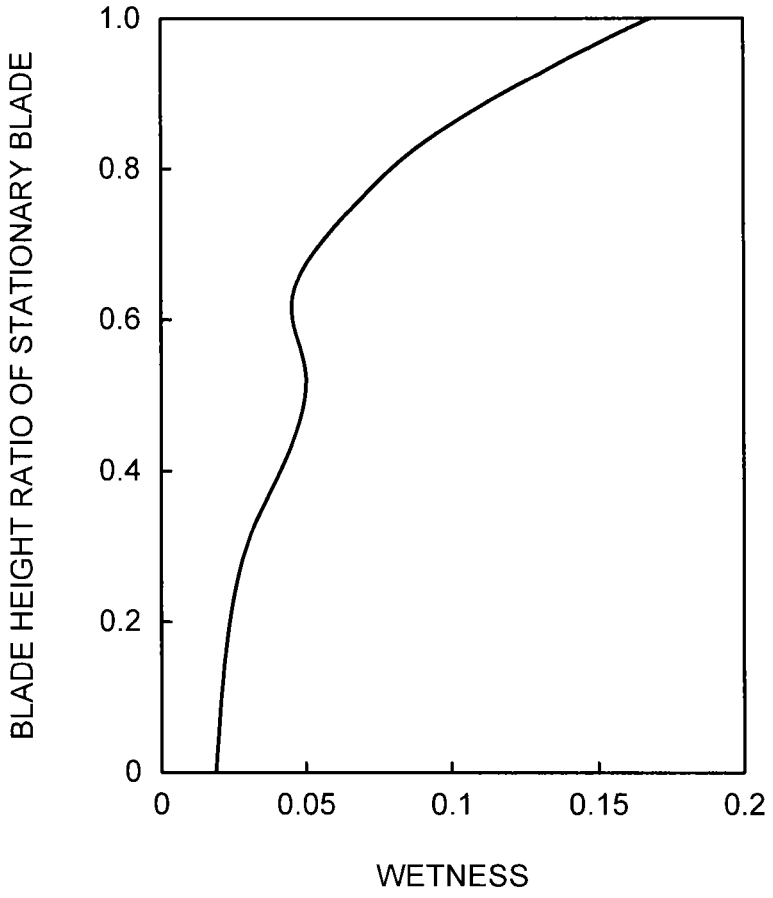
FIG. 13 is a view illustrating a distribution of wetness of steam in a blade height direction of a stationary blade at the final turbine stage of the conventional low-pressure turbine.

Here, a reason why a range of the part where the extending part 90 is formed is set to be 90% or more of the blade height from the blade root is that the wetness exceeds 0.1 (10%) at 90% or more of the blade height as illustrated in FIG. 13. As a result of an internal observation of an actual operating steam turbine, it turns out that formations of the water film and waterway become remarkable when the wetness exceeds 0.1.

As stated above, the extending part 90 is included, and thereby, it is possible to collect the water film before the water film remaining at the end part 90*a* at the downstream side of the extending part 90 scatters.

Note that in the first embodiment, an example in which the annular slit 40 and the communications holes 50 are provided for one stage between the stationary blade 26 and the rotor blade 22 is illustrated, but the constitution is not limited thereto. The annular slit 40 and the communication holes 50 may be, for example, included in plural stages in the turbine rotor axis direction between the stationary blade 26 and the rotor blade 22.

Second Embodiment

Figure 9:
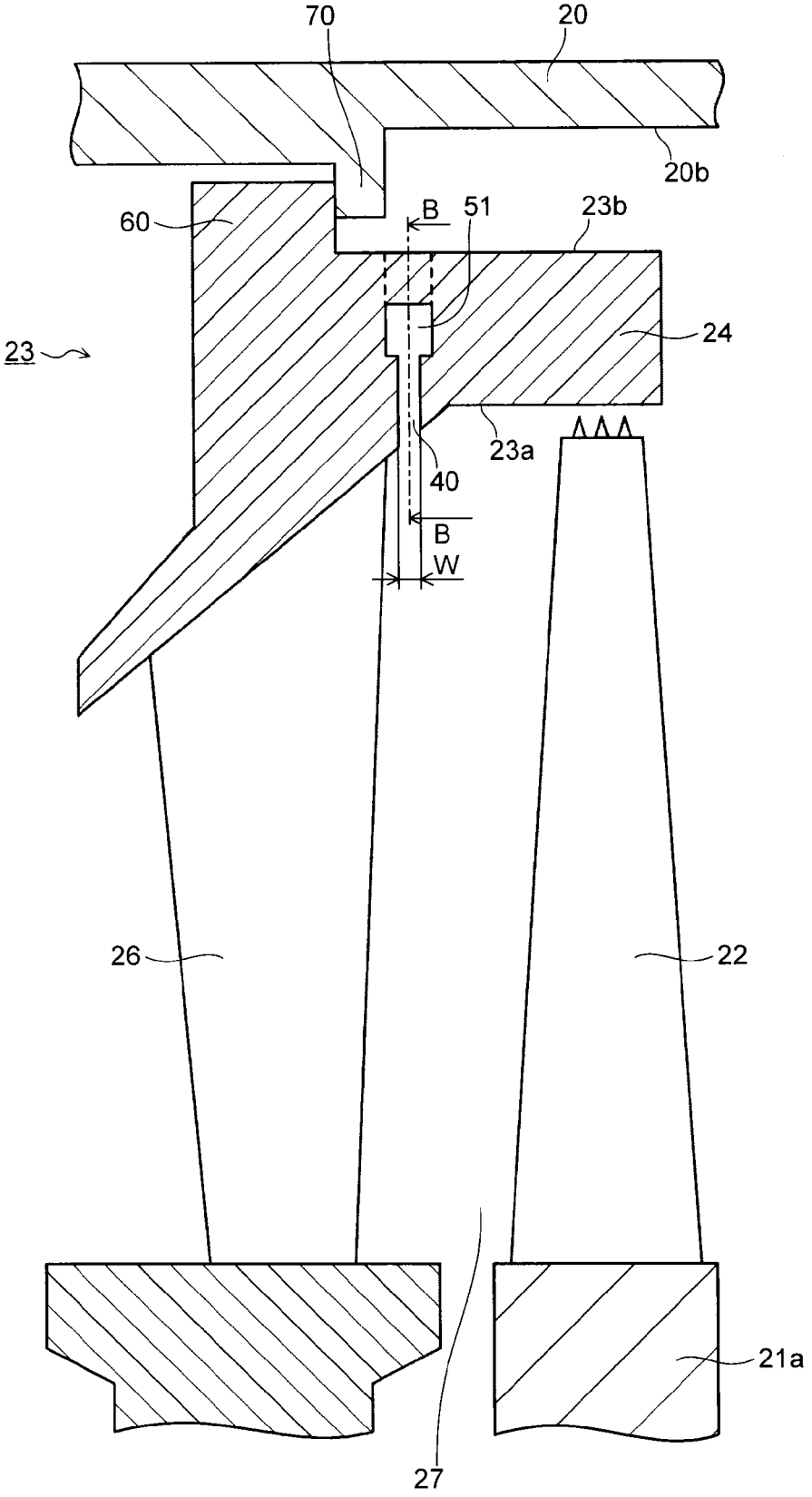
FIG. 9 is a view illustrating a cross section in a vertical direction at an upper half side of a final turbine stage in a steam turbine according to a second embodiment.
Figure 10:
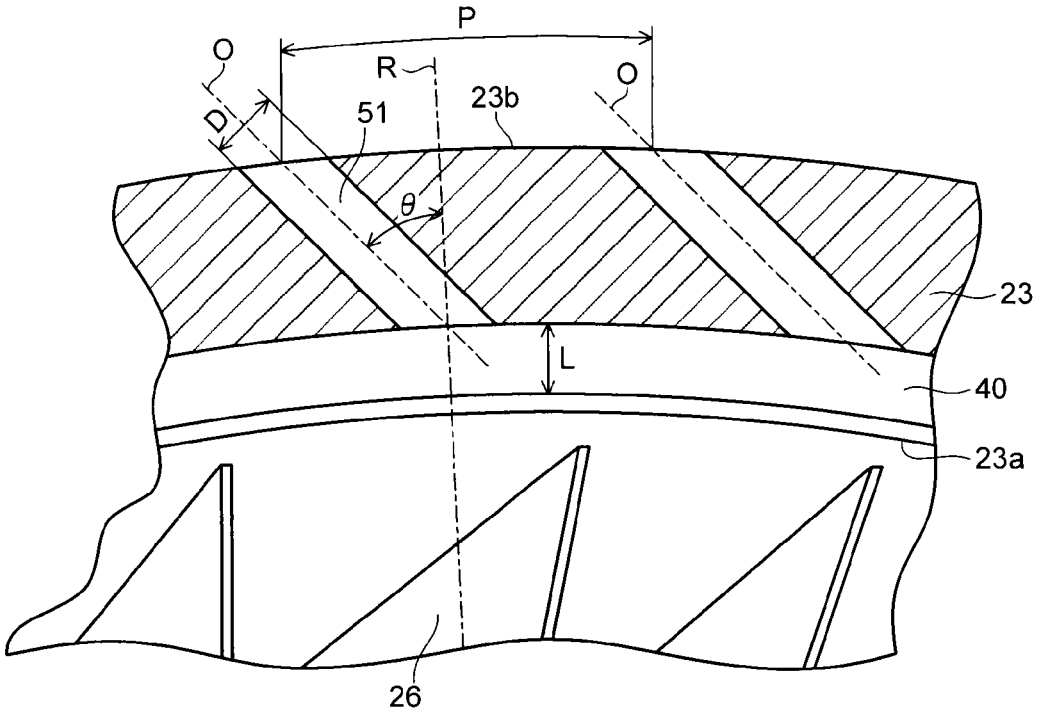
FIG. 10 is a view illustrating a B-B cross section in FIG. 9.

FIG. 9 is a view illustrating a cross section in a vertical direction of an upper half side of a final turbine stage in a steam turbine 11 according to a second embodiment. FIG. 10 is a view illustrating a B-B cross section in FIG. 9. Note that the same reference symbols are added for the same components as the constitution of the steam turbine 10 according to the first embodiment, and redundant descriptions are not given or simplified.

In the steam turbine 11 according to the second embodiment, a constitution is the same as the constitution of the steam turbine 10 according to the first embodiment except a constitution of a communication hole. Here, the communication hole is mainly described.

As illustrated in FIG. 9 and FIG. 10, a communication hole 51 inclines relative to a radial line R extending from the center axis of the turbine rotor 21 in the radial direction at a cross section perpendicular to the turbine rotor axis direction. This inclination direction is not particularly limited, but it is preferably a reverse direction to a turning direction of the steam passing through the stationary blade 26 so as to suppress the flowing of the steam into the communication hole 51. The communication hole 51 is preferably formed by, for example, a round hole in which a shape at a cross section perpendicular to a center axis O becomes a circle.

An inclination angle θ being an acute angle made up of the center axis O of the communication hole 51 and the radial line R is preferably more than "0" (zero) degree and 75 degrees or less. The inclination angle θ is set to be more than "0" (zero) degree, and thereby, a communication area between the communication hole 51 and the annular slit 40 increases, and an opening area in the circumferential direction directly sucking the water film and the water droplets from the annular slit 40 increases. Accordingly, it is possible to surely collect the water droplets and the water film dispersed in the circumferential direction. When the inclination angle θ exceeds 75 degrees, it becomes difficult to form the communication hole 51 from a point of view of manufacturing. A more preferable range of the inclination angle θ is 30 degrees or more and 75 degrees or less.

When the communication hole 51 is formed by the round hole, a pitch of the communication hole 51 in the circumferential direction is P, a diameter of the round hole of the communication hole 51 is D, and the inclination angle of the communication hole 51 is θ, it is preferable that a relationship of the following expression (1) is satisfied.

$$P/(D\cdot\sec\theta)\leq 5 \qquad \text{expression (1)}$$

When a value of P/(D·secθ) is "5" or less, an effect sucking the water film and the water droplets is obtained in the circumferential direction without pause even if the inclination angle θ is less than 30 degrees. Note that a lower limit value of the P/(D·secθ) is preferably approximately two to maintain strength of the diaphragm outer ring 23 at a part where the communication hole 51 is not provided, and because a ratio sucking not only the water droplets but also the accompanying main stream increases when a hole area is excessive.

The expression (1) is satisfied, and thereby, it is possible to surely collect the water droplets and the water film dispersed in the circumferential direction. Besides, it is preferable to satisfy a relationship of the following expression (2) in addition to the expression (1) to enable a more surely collection of the water droplets and the water film.

$$L/W\geq 3 \qquad \text{expression (2)}$$

Here, "L" is a groove depth (refer to FIG. 10) of the annular slit 40 in the radial direction, "W" is a groove width (refer to FIG. 9) of the annular slit 40 in the turbine rotor axis direction.

When a value of L/W is three or more, it is possible to surely collect the water droplets and the water film dispersed in the circumferential direction. A maximum value of the L/W is, for example, approximately 20 from a point of view of reducing an abrasion cost of a lathe cutter which processes the groove. Besides, the grove width W is preferably 10 mm or less in consideration of application for an actual product, a size of the groove depth L, and so on.

Figure 11:
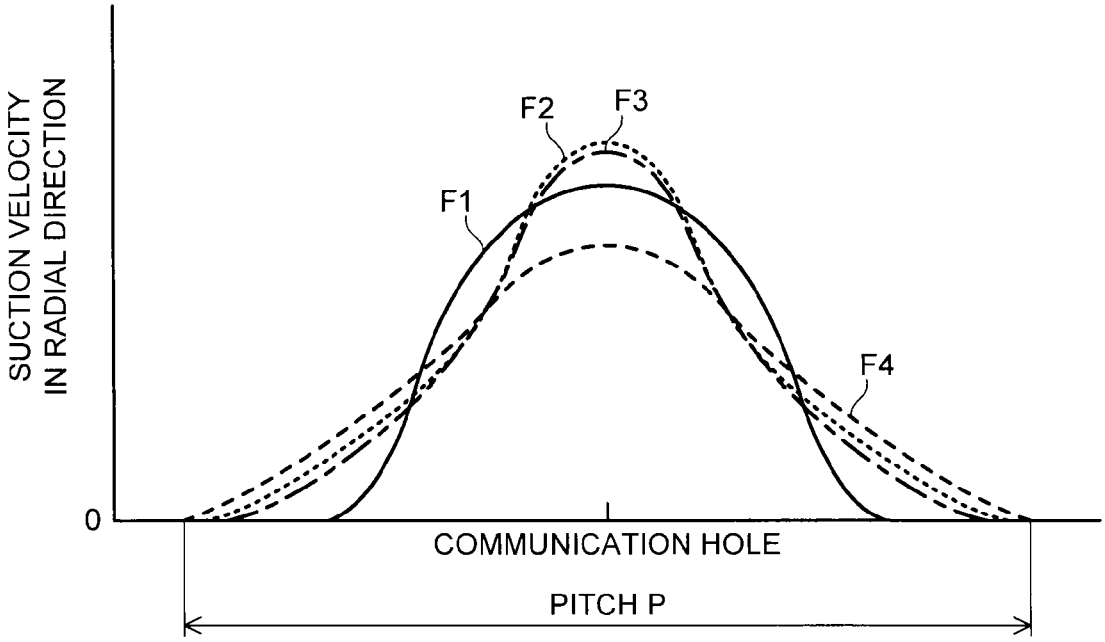
FIG. 11 is a view illustrating a circumferential distribution of a suction velocity in a radial direction at an inlet of the annular slit.
Figure 12:
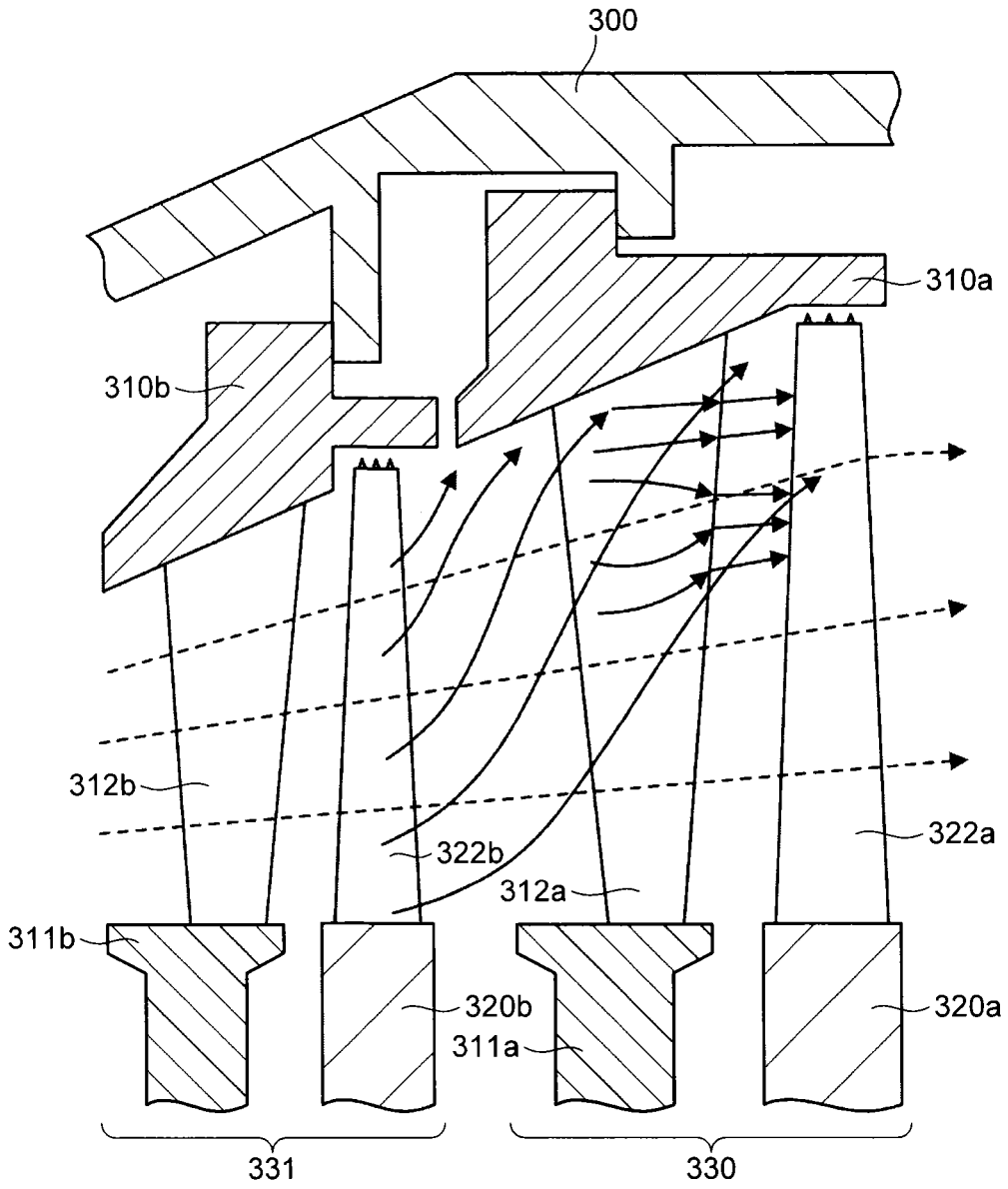
FIG. 12 is a view illustrating a meridian cross section in a vicinity of a final turbine stage at a conventional low-pressure turbine.

Here, FIG. 11 is a view illustrating a circumferential distribution of a suction velocity in the radial direction at an inlet of the annular slit 40. Note that the inlet of the annular slit 40 positions at the steam passage 27 side.

Here, FIG. 11 illustrates the circumferential distribution within a range of the pitch P in the circumferential direction of the communication hole 51 centering on the communication hole 51. Besides, results illustrated in FIG. 11 are results obtained by a computational fluid analysis.

In each of analysis models F1 to F4, the communication hole 51 was formed by the round hole, the P/D was set to be 10, and the inclination angle θ of the communication hole 51 was set to be 60 degrees. As for the L/W, it was two in F1, it was three in F2, it was eight in F3, and it was 16 in F4.

As illustrated in FIG. 11, in F1 whose value of the L/W is two, a spread of the circumferential distribution of the suction velocity in the circumferential direction is small. When the value of the L/W is "3" or more (F2 to F4), the spread of the circumferential distribution of the suction velocity in the circumferential direction is wide, and it can be seen that the water droplets and the water film are sucked from the annular slit 40 at approximately a whole range of the pitch P. It is thereby turned out that it is possible to uniformly perform the suction of the water film and the water droplets at the annular slit 40 along the circumferential direction when the value of the L/W is three or more (F2 to F4).

According to the steam turbine 11 of the second embodiment, the annular slit 40 is included along the circumferential direction, and the inclination angle θ of the communication hole 51 relative to the radial line R is set to be within the above-stated range, and thereby, it is possible to surely collect the water droplets and the water film dispersed in the circumferential direction. It is thereby possible to suppress the erosion caused by the collision of the water droplets with the rotor blade 22 at the immediate downstream side of the stationary blade 26 and the lowering of the turbine efficiency. Besides, the value of the L/W is set to be within the above-stated range, and thereby, it is possible to more surely collect the water droplets and the water film dispersed in the circumferential direction.

Note that in the second embodiment, it is also possible to include each constitution according to FIG. 5 to FIG. 8 described in the first embodiment, and it is possible to obtain the similar operation and effect as each constitution.

According to the above-described embodiments, it becomes possible to surely remove the generated water droplets and the water film along the circumferential direction.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A steam turbine where wet steam flows in a turbine stage in low-pressure, comprising:

rotor blades implanted in a circumferential direction to a turbine rotor provided to penetrate in a casing;

stationary blades provided at an immediate upstream side of the rotor blades in the circumferential direction, and making up a turbine stage together with the rotor blades;

diaphragm outer rings provided inside the casing, each including an annular extending part surrounding a periphery of the rotor blades, and supporting the stationary blades from outside in a radial direction;

diaphragm inner rings supporting the stationary blades from inside in the radial direction;

an annular slit formed at an inner surface of the diaphragm outer ring between the stationary blades and the rotor blades along the circumferential direction; and communication holes provided in plural at an outer surface of the diaphragm outer ring along the circumferential direction, the communication holes communicating to the annular slit from an outer surface side of the diaphragm outer ring, the communication holes connecting to the annular slit directly, the communication holes communicating to a suction part sucking liquid via the annular slit, the communication holes inclining relative to a radial line extending from a center axis of the turbine rotor in the radial direction at a cross section perpendicular to the turbine rotor axis direction, the communication holes inclining toward a reverse direction to a turning direction of the wet steam passed through between the stationary blades.

2. The steam turbine according to claim 1, wherein an inclination angle of the communication hole relative to the radial line is more than "0" (zero) degree and 75 degrees or less.

3. The steam turbine according to claim 1, wherein when the communication hole is formed by a round hole, a pitch of the communication hole in the circumferential direction is P, a diameter of the round hole of the communication hole is D, and the inclination angle of the communication hole relative to the radial line is θ, a value of $P/(D \cdot \sec\theta)$ is five or less.

4. The steam turbine according to claim 1, wherein when a groove depth of the annular slit in the radial direction is L, a groove width of the annular slit in the turbine rotor axis direction is W, a value of LW is three or more.

5. The steam turbine according to claim 4, wherein the groove width W is 10 mm or less.

6. The steam turbine according to claim 1, wherein the communication hole is formed along a radial line extending from the center axis of the turbine rotor in the radial direction at a cross section perpendicular to the turbine rotor axis direction.

7. The steam turbine according to claim 1, wherein an end part at an upstream side of the annular slit facing the inner surface of the diaphragm outer ring is on a circumference including an intersection point between a trailing edge of a blade tip of the stationary blade and the diaphragm outer ring.

8. The steam turbine according to claim 1,
wherein at a trailing edge of the stationary blade positioning at 90% or more of a blade height from a blade root, the trailing edge extends as it goes to a blade tip.

9. The steam turbine according to claim 1,
wherein an end part at an upstream side of the annular slit facing the inner surface of the diaphragm outer ring is chamfered.

10. The steam turbine according to claim 1,
wherein an acute angle $\alpha$ made up of the turbine rotor axis direction and the inner surface of the diaphragm outer ring where the annular slit is formed is smaller than an acute angle $\beta$ made up of the turbine rotor axis direction and the inner surface of the diaphragm outer ring at an upstream side than the annular slit.

11. The steam turbine according to claim 10,
wherein the acute angle $\alpha$ is "0" (zero).

12. The steam turbine according to claim 1,
wherein the annular slit is formed in plural stages in the turbine rotor axis direction between the stationary blades and the rotor blades.

13. The steam turbine according to claim 1,
wherein the diaphragm outer ring where the annular slit is formed is included in a turbine stage where wet steam flows.

* * * * *